US008555603B1

(12) United States Patent
Perry

(10) Patent No.: US 8,555,603 B1
(45) Date of Patent: Oct. 15, 2013

(54) POLE TOP EXTENSION

(76) Inventor: Andrew Perry, Lancaster, CA (US)

( * ) Notice: Subject to any disclaimer, the term of this patent is extended or adjusted under 35 U.S.C. 154(b) by 0 days.

(21) Appl. No.: 13/573,153

(22) Filed: Aug. 27, 2012

Related U.S. Application Data

(60) Provisional application No. 61/540,781, filed on Sep. 29, 2011.

(51) Int. Cl.
*E04C 3/00* (2006.01)

(52) U.S. Cl.
USPC ..... 52/848; 52/849; 52/835; 52/854

(58) Field of Classification Search
USPC ..... 52/848, 849, 835, 854; 248/218.4, 248/219.2, 230.3, 534; 403/286, 300, 301, 403/310, 312
See application file for complete search history.

(56) References Cited

U.S. PATENT DOCUMENTS

| | | | | |
|---|---|---|---|---|
| 1,420,430 | A | 6/1922 | Jaeckle | |
| 3,201,834 | A | 8/1965 | Battinger | |
| 3,802,206 | A | 4/1974 | Moore | |
| 3,817,394 | A | 6/1974 | Saiki | |
| 3,921,949 | A | 11/1975 | Coon | |
| 4,032,244 | A | 6/1977 | Quayle | |
| 4,048,779 | A | 9/1977 | Valenziano | |
| 4,092,079 | A | 5/1978 | Swanson | |
| 4,097,165 | A | 6/1978 | Quayle | |
| 4,577,449 | A | 3/1986 | Celli | |
| 4,689,889 | A | 9/1987 | Reeves | |
| 5,222,344 | A | 6/1993 | Johnson | |
| 5,230,176 | A | 7/1993 | Schomaker | |
| 5,360,191 | A | 11/1994 | Carson | |
| 5,444,951 | A | 8/1995 | Scott | |
| 5,661,946 | A | 9/1997 | Davis | |
| 8,387,569 | B2 * | 3/2013 | Davis | 119/531 |

OTHER PUBLICATIONS

Shakespeare Composite Solutions, Pole Top Extensions-Heavy Duty, Web Page, www.skp-cs.com, 2 pages, obtained Aug. 8, 2012.

* cited by examiner

*Primary Examiner* — Mark Wendell
(74) *Attorney, Agent, or Firm* — Dennis W. Beech

(57) ABSTRACT

A device with a base member with a tubular socket attached orthogonal to a first attachment beam and the first attachment beam has a generally rectangular cross section shape. An insert member of an attachment member is inserted in the tubular socket and a second attachment beam is attached orthogonal to the insert member for each beam to be positioned opposed and spaced apart to abut opposite sides of a pole when the socket is positioned on the top of a pole. The first and second attachment beams may have fastening loops attached for attaching cables diagonally between a loop at one of the lower ends of each attachment beam and a loop adjacent the socket or the insert member. Cable adjustment brackets with tightening bolts may be attached to the outside surface of each attachment beam for each cable end attachment for use to tension the cables.

9 Claims, 3 Drawing Sheets

POLE TOP EXTENSION

This patent application claims the benefit of U.S. Provisional Application No. 61/540,781 filed on Sep. 29, 2011.

BACKGROUND OF THE INVENTION

This invention relates to devices for extending the height of a pole. The new pole top extension device has a base member and an attachment member combined and attached to the top portion of a pole by fasteners and cables to support an extension pole.

There are various devices and apparatus to support pole elements such as straps, brackets and the like. There may also be devices to attach to the top of a pole to support an extension pole. These devices may have a bracket assembly with a pair of opposed legs that are adapted or formed to extend circumferentially partially around a side of a pole and to extend downwardly at a top portion of the pole. Transversely inserted fasteners extend through the pole and the legs to secure the bracket assembly to the pole. An extension pole may be attached at the top of the bracket assembly. Analysis of this type of pole extension bracket assembly indicate that with certain types of equipment mounted on the extension pole, for example, cellular telephone antenna and other electronic equipment, that stressful environmental factors may cause this type of bracket assembly to fail or be unsafe.

SUMMARY OF THE INVENTION

The present invention is directed to devices for extending the height of a pole. A base member may have a tubular socket attached approximately orthogonal to a first attachment beam at a first pole engagement surface that is flat and the first attachment beam has a generally rectangular cross section shape with four generally orthogonal elongated surfaces. An insert member of an attachment member is inserted in the tubular socket and a second attachment beam attached approximately orthogonal to the insert member may be positioned opposed, spaced apart and parallel to the first attachment beam to abut opposite sides of a pole when the socket is positioned on the top of a pole. The first and second attachment beams may be attached to the top portion of the pole by multiple fasteners extending transversely through the top portion of the pole and through holes in each of the first and second attachment beams. The first and second attachment beams may have fastening loops attached adjacent the socket, the insert member, and the lower ends of each attachment beam and on each side wall of each attachment beam. A cable may be attached diagonally between a fastening loop at one of the lower ends of each attachment beam and the fastening loop adjacent the socket or the insert member to form crossed cables at the top portion of a pole on opposed sides of the pole. The cables may be tensioned with tools. Alternatively, cable adjustment brackets with tightening bolts may be attached to the outside surface of each attachment beam for each cable end attachment for use to tension the cables.

These and other features, aspects and advantages of the present invention will become better understood with reference to the following drawings, description and claims.

BRIEF DESCRIPTION OF THE DRAWINGS

FIG. 2A illustrates an partial exploded perspective view of an attachment beam according to an embodiment of the invention;

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
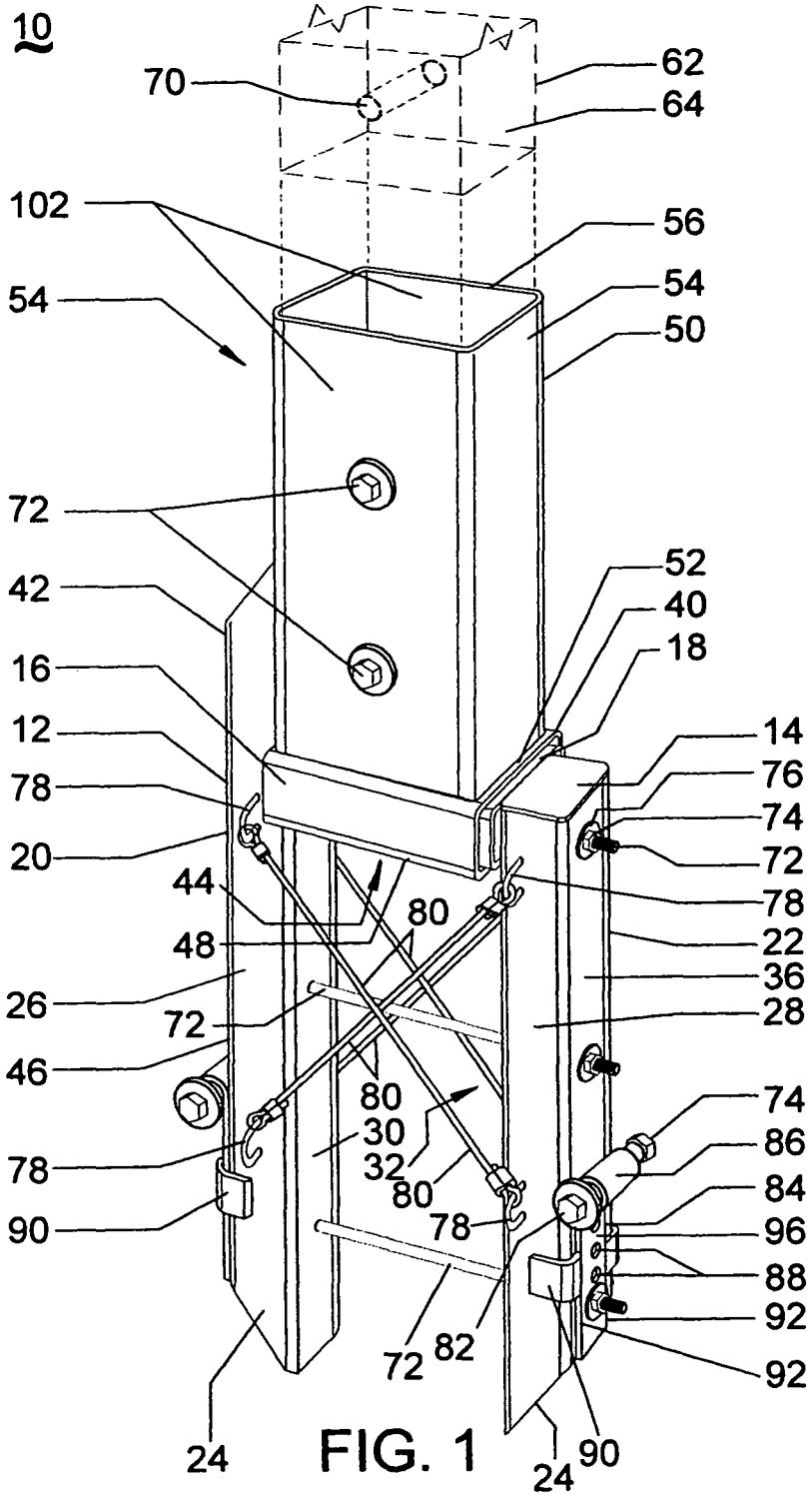
FIG. 1 illustrates a perspective elevation view of the pole top extension device according to an embodiment of the invention.
Figure 2:
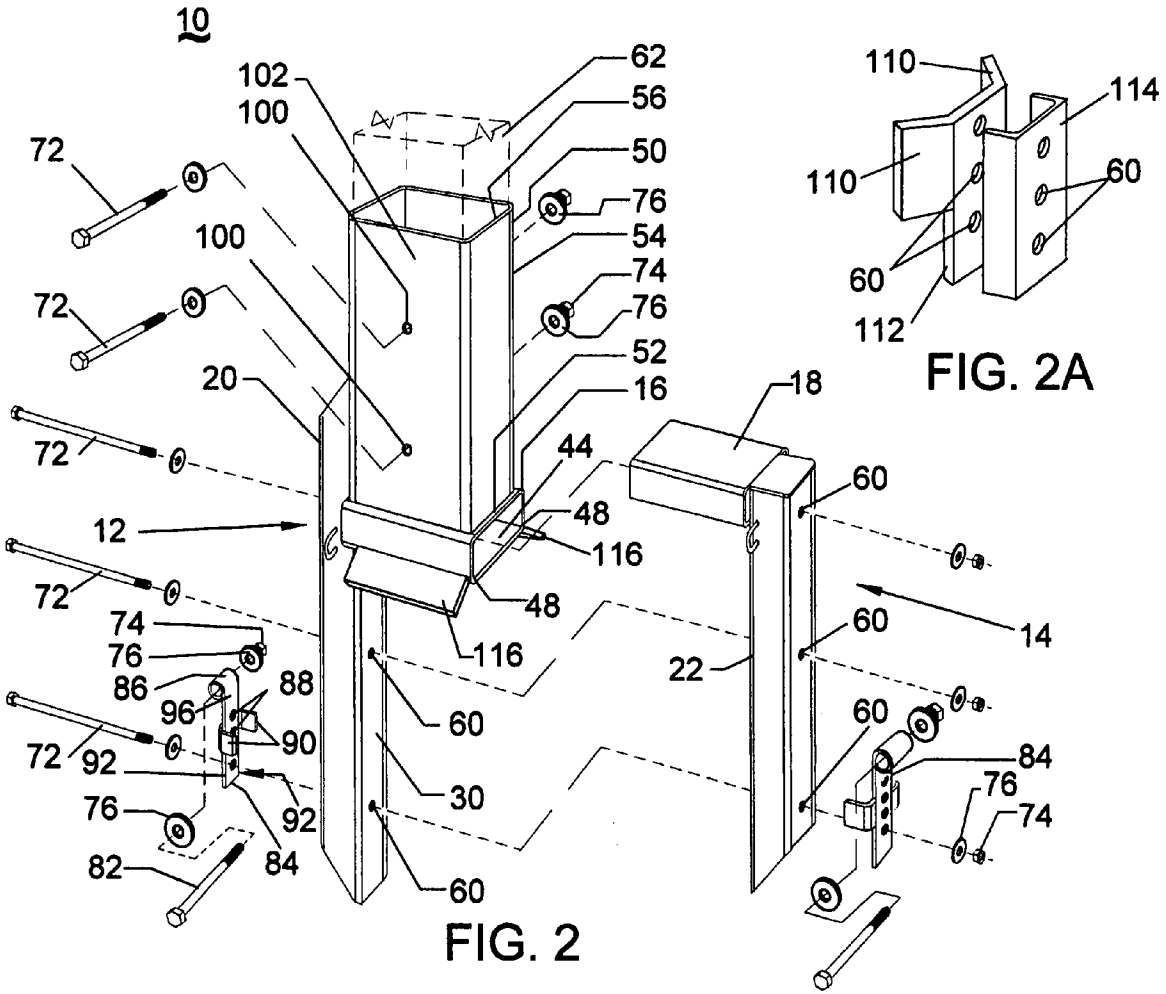
FIG. 2 illustrates an exploded perspective view of the pole top extension device according to an embodiment of the invention.
Figure 3:
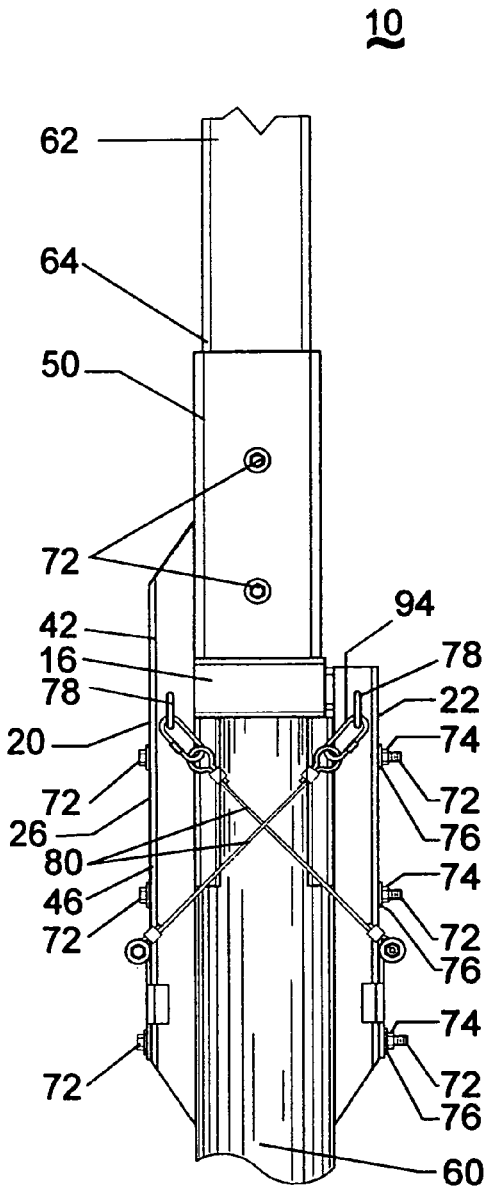
FIG. 3 illustrates a side elevation view of the pole top extension device with cable adjustment brackets and cables according to an embodiment of the invention.
Figure 4:
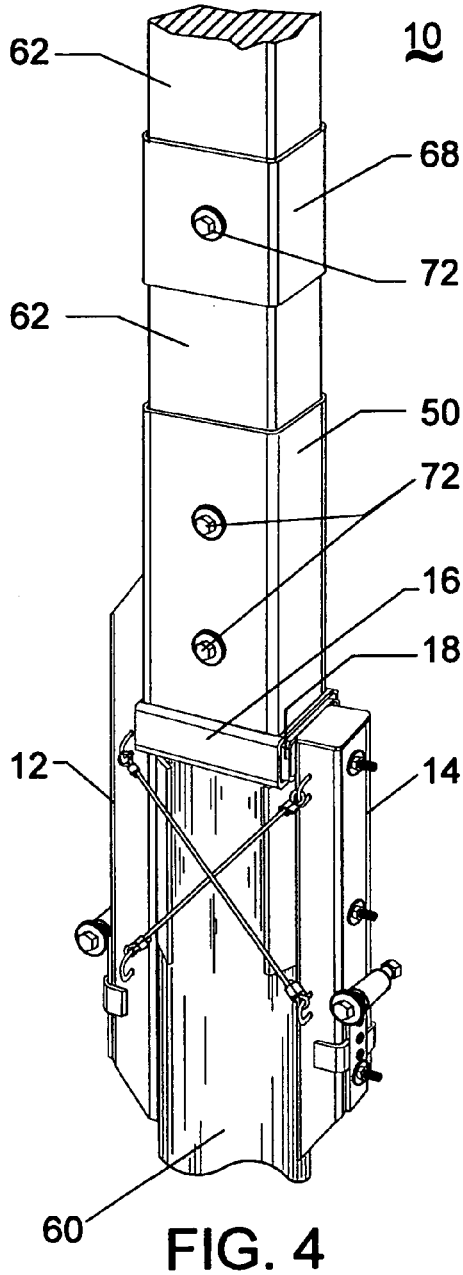
FIG. 4 illustrates a perspective elevation view of the pole top extension device with an extension beam and cable adjustment brackets without cables according to an embodiment of the invention.

Referring to FIGS. 1 through 3, a pole top extension 10 device has a base member 12 and an attachment member 14. The base member 12 has a hollow generally rectangular tubular socket 16 attached generally orthogonal to a first attachment beam 20 at a pole engagement wall 30 with a flat surface. The attachment member 14 has a generally rectangular insert member 18 or plug that may be a hollow tubular form and is sized to be inserted in the socket 16. The insert member 18 is attached generally orthogonal to a second attachment beam 22 at a pole engagement wall 32 with a flat surface and is positioned such that when inserted in the socket 16 the first and second attachment beams 20, 22 are generally oriented parallel and spaced apart one to the other.

A generally rectangular tube support bracket 50 is attached at a first end 52 to the upper wall 40 of the socket 16 and at a side wall 54 to an upper portion 42 of the first attachment beam 20 and has a second end 56 open for receipt of an end of an extension beam 62. When the base member 12 is positioned with the lower wall 44 of the socket 16 on the top of a pole 60 and the lower portion 46 of the first attachment beam 20 positioned against the side of the pole 60, the support bracket 50 longitudinal center line is oriented generally parallel to the pole 60. An extension beam 62 with a first end 64 inserted in the support bracket 50 may be in a generally vertical orientation as an extension member of the pole 60.

To secure or attach the base member 12 to the pole 60 the insert member 18 may be inserted in the socket 16 with the second attachment beam 22 positioned against the side of the pole 60. Bolt holes 70 may be formed in each attachment beam 20, 22 at opposed vertical positions for inserting bolts 72 through the beams 20, 22 and the pole 60. The threaded ends of the bolts 72 may be secured by nuts 74. Opposed bolt holes 70 may also be formed in each beam 20, 22 for inserting a bolt 72 through each beam 20, 22 and through the socket 16 and insert member 18. It has been found that two bolts 72 through the pole 60 and beams 20, 22 and one bolt 72 through the socket 16 and insert 18 can support an extension beam 62 on a pole 60 for benign environmental conditions.

It has been found be analysis that for locations that may experience more severe environments and require extension beams on top of poles located in urban environments for mounting additional equipment or new applications such as cellular telephone antennas that a more structurally secure attachment is necessary for reliability and safety. The poles 60 may be circular, rectangular or other cross-sectional form and may be of varying diameter.

The pole top extension 10 device may have a secured bolt 72 through the socket 16 and insert member 18 for further integrity of the pole 60 attachment structure. Additionally, a pair of opposed fastening loops 78 may each be attached on each attachment beam 20, 22 adjacent the socket 16 and insert member 18 and on each attachment beam 20, 22 adjacent a lower end 24. The fastening loops 78 are attached on each side wall 26 and 28 of the attachment beams 20, 22. A cable 80 is attached between diagonal opposed fastening loops 78 as best viewed in FIG. 3 and are tensioned for maintaining the pole top extension 10 in position on top of a pole 60. The use of the cables 80 and the secured bolts 72 with the structure of the base member 12 and attachment member 14 incorporate 360 degree support for extension beam 62 mounted equipment during generally known environmental conditions.

The attachment beams 20, 22, socket 16 and insert member 18, and the support bracket 50 may be formed from metal material that is weldable, for example, steel. For relatively inexpensive elements and ease of assembly, the beams 20, 22, socket 16, insert member 18, and support bracket 50 may all be cut from stock steel rectangular tubing of the desired size and shape for an application and welded together. Standard bolts 72, nuts 74 and washer 76 may be used for the secure bolt attachments.

Cables 80 may be constructed of material with sufficient tensile strength for the expected extension beam 62 attached load and the expected environmental conditions. The cables 80 may be tensioned when attached by using known tools. The pole top extension 10 attachment beams 20, 22 may also be augmented to allow tensioning of preformed cables of selected lengths by incorporating tightening bolts 82. A cable adjustment bracket 84 with a rectangular plate 96 and a hollow cylindrical end 86 for receipt of tightening bolts 82 may have spaced apart bracket holes 88 for attachment to one of the bolts 72, as best viewed in FIGS. 1 and 2. The bracket 84 may have tabs 90 on opposed edges 92 to be positioned to abut the side walls 26, 28 of the attachment beams 20, 22.

Referring to FIGS. 1 and 3, once the base member 12 and attachment member 14 are assembled and bolted at the top of a pole 60, the crossing or diagonal cables 80 may be attached at one end by use of an attachment ring 94. The second end of each cable 80 may then be attached to a tightening bolt 72 with washers 76 and nuts 64. The tightening bolts 72 may then be adjusted using a wrench to balance the tension in the crossing cables 80 to firmly attach the pole top extension 10 to the top of a pole 60. If necessary, the bolts 72 may also be adjusted or tightened.

Referring to FIGS. 1 through 4, an extension beam 62 may have one end 64 inserted in the support bracket 50 and may be attached by one or more bolts 72 inserted through holes 100 in the side walls 102 and through the extension beam 62. If the length of the extension beam 62 and the load of equipment to be installed require strengthening of the central portion of the extension beam 62, a sleeve 68 may be installed on the extension beam 62 and fastened with a bolt 72 and a nut, as best viewed in FIG. 4.

Referring to FIGS. 1 through 4, the insert member 18 may be a hollow rectangular tube form. The attachment beams 20, 22 may have extending flanges 110 angled to more closely follow the curvature of the top of a round pole 60. In this configuration the attachment beams 20, 22 may be formed with a bar 112 with bent flanges 110 that is welded to a channel 114. The socket 16 at the sides 48 of the lower wall 44 may have subtending flanges 116 to abut the top end of a pole 60 that may narrow in diameter at the top end.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for extending the height of a pole comprising:

a base member with a tubular socket attached approximately orthogonal to a first attachment beam at a first pole engagement wall with a flat surface wherein said first attachment beam has a generally rectangular cross section shape with four generally orthogonal surfaces;

an attachment member with an insert member shaped for insertion in said tubular socket and said insert member is attached approximately orthogonal to a second attachment beam at a second pole engagement wall with a flat surface wherein said second attachment beam has a generally rectangular cross section shape with four generally orthogonal surfaces;

a tubular support bracket is attached at a first end to an upper wall of said tubular socket and at a side wall to an upper portion of said first attachment beam wherein said tubular support bracket has an open second end;

said first attachment beam having a plurality of apertures therethrough generally parallel to said socket at said first pole engagement wall and said second attachment beam having a plurality of apertures therethrough generally parallel to said insert member at said second pole engagement wall;

a plurality of fastening loops are each attached at a first side surface and an opposed second side surface adjacent said socket and a lower end of said first attachment beam, and at a first side surface and an opposed second side surface adjacent said insert member and a lower end of said second attachment beam.

2. The device as in claim 1 wherein:

said insert member is inserted in said socket disposed for said first attachment beam and said second attachment beam to abut opposed sides of the top portion of a pole when said socket is positioned on the top end of said pole;

a plurality of fasteners extend transversely through said pole and through said socket and said insert member, and through said plurality of apertures in said first attachment beam and said second attachment beam;

a plurality of cables are attached between each fastening loop at said first side surface adjacent said socket and said lower end of said second attachment beam, at said first side surface adjacent said insert member and said lower end of said first attachment beam, at said opposed second side surface adjacent said socket and said lower end of said opposed second side surface of said second attachment beam, and at said opposed second side surface adjacent said insert member and said lower end of said opposed second side surface of said first attachment beam.

3. The device as in claim 1 wherein:

a cable adjustment bracket has a rectangular plate with a hollow cylindrical end and a pair of tabs attached orthogonally at opposed edges;

said rectangular plate having a plurality of bracket holes therein;

a tightening bolt disposed in said hollow cylindrical end; and a first cable adjustment bracket attached to said lower end of said first attachment beam and a second cable adjustment bracket attached to said lower end of said second attachment beam.

4. The device as in claim 1 wherein an extension beam is inserted at a first end in said support bracket and a fastener is transversely positioned through said first end and two opposed side walls of said support bracket.

5. The device as in claim 4 wherein a sleeve is disposed on said extension beam and retained by a transverse fastener through two opposed side walls of said sleeve and said extension beam.

6. The device as in claim 1 wherein said first and said second attachment beams, said socket, said insert member and said support bracket are formed of generally rectangular tubular shaped material.

7. The device as in claim 6 wherein said rectangular tubular shaped material is steel.

8. The device as in claim 1 wherein said first and said second attachment beams are formed of an elongated bar welded to an elongated channel and each of said elongated bars has said pole engagement surface and a pair of opposed flanges attached at an angle to conform to the curvature of a round pole.

9. The device as in claim 1 wherein said socket at a lower wall has a pair of subtending opposed flanges attached at opposed ends of said lower wall.

* * * * *